US006502733B1

(12) United States Patent
Gebhardt et al.

(10) Patent No.: US 6,502,733 B1
(45) Date of Patent: Jan. 7, 2003

(54) SERVICE TRAY

(75) Inventors: Paul E. Gebhardt, Oneida, NY (US); Theodore P. Junko, Manlius, NY (US)

(73) Assignee: Oneida Ltd., Oneida, NY (US)

( * ) Notice: Subject to any disclaimer, the term of this patent is extended or adjusted under 35 U.S.C. 154(b) by 0 days.

(21) Appl. No.: 09/971,532

(22) Filed: Oct. 5, 2001

(51) Int. Cl.[7] ..... B65D 21/02

(52) U.S. Cl. ..... 226/23.86; 16/425; 220/23.4; 220/759; 294/27.1

(58) Field of Search ..... 220/23.86, 23.4, 220/556, 756, 752, 759, 775, 776, 772, 699, 735, 736; 16/422, 425, 426; 294/27.1; D7/552.1

(56) References Cited

U.S. PATENT DOCUMENTS

| | | | | | |
|---|---|---|---|---|---|
| 430,984 | A | * | 6/1890 | Benvenisti | 126/220 |
| 1,569,184 | A | * | 1/1926 | Herring | 294/15 |
| 1,580,582 | A | * | 4/1926 | Carman | 220/756 |
| 1,740,211 | A | * | 12/1929 | Vahouny | 294/27.1 |
| 2,072,569 | A | * | 3/1937 | Shoan | 220/759 |
| 2,211,391 | A | * | 8/1940 | Shocky | 294/15 |
| 2,574,411 | A | * | 11/1951 | Pashby | 220/759 |
| 3,123,935 | A | | 3/1964 | Williams | |
| D207,593 | S | | 5/1967 | Douglas | |
| 3,381,825 | A | * | 5/1968 | Bessett | 211/126.16 |
| D260,345 | S | | 8/1981 | Goodrich | |
| 4,688,541 | A | | 8/1987 | Stephen et al. | |
| 4,867,506 | A | | 9/1989 | Chavez | |
| 5,176,259 | A | | 1/1993 | Andersen | |
| 5,419,455 | A | * | 5/1995 | Russeau | 206/562 |
| 5,669,313 | A | | 9/1997 | Cottingham | |

* cited by examiner

*Primary Examiner*—Nathan J. Newhouse
*Assistant Examiner*—Joseph C. Merck
(74) *Attorney, Agent, or Firm*—Wall Marjama & Bilinski LLP

(57) ABSTRACT

Apparatus for extending the carrying capacity of a tray that includes a serving tray having primary handles located at either end of the tray. An open top container is placed over one or both of the primary handles and is releasably secured to the tray by a snap-over latch. Each container further includes auxiliary handles that extend outwardly from the container beyond the primary handles. The auxiliary handles are arranged to pass under the primary handles when the containers are attached to the tray to provide a secure and well balanced means for carrying the tray.

7 Claims, 1 Drawing Sheet

SERVICE TRAY

FIELD OF THE INVENTION

This invention relates to a tray generally suited for carrying food and related utensils and, in particular, to apparatus for increasing the carrying capacity of a tray.

BACKGROUND OF THE INVENTION

Serving trays are utilized in most hotels and motels, as well as other institutions such as hospitals and rest homes, to bring food to individuals who cannot or do not wish to visit the facility's restaurant. Depending on the size of the food order, the serving tray's capacity can be overtaxed and the tray can be loaded to a point where it is difficult to handle and articles carried on the tray can become dislodged and fall from the tray. This can pose a danger to the server and the person being served, particularly when hot food items such as coffee, tea and soup are loaded upon the tray. To avoid overloading of the tray, the server, at times, may find it necessary to make more than one trip from the restaurant to the individual thus consuming a relatively good bit of time that might be put to other use. As will be explained in detail below, the tray of the present invention includes one or more open top containers that can be snap-fitted as needed to the tray to expand the tray's carrying capacity. These containers can be preloaded with utensils, condiments and the like and attached as needed to the trays.

Off loading articles from an overloaded tray oftentimes results in the server having to use a bulky serving cart or making more than one trip to the individual's location.

SUMMARY OF THE INVENTION

It is, therefore, an object of the present invention to improve serving trays.

It is a further object of the present invention to improve serving trays of the type utilized in hotels and the like for bringing food to the guests' rooms.

A still further object of the present invention is to increase the carrying capacity of a serving tray.

Another object of the present invention is to increase the carrying capacity of a serving tray without compromising the security of the articles situated upon the tray.

It is yet another object of the present invention to provide preloaded open top containers for holding utensils, condiments and the like that can be snap-fitted to a tray as needed to extend the carrying capacity of the tray.

These and other objects of the present invention are attained by a serving tray having primary handles connected to either end of the tray. An open top container having a flat bottom wall and elevated side walls is releasably secured by a latch to one end of the tray so that the container overlies one of the primary handles. The container includes an auxiliary handle that extends outwardly beyond the primary handle which is utilized to carry the tray. The auxiliary handle is adapted to pass under the primary handles into the latched position thus providing a secure and well-balanced means for carrying the tray depending upon the load that is to be carried, one or two extra containers may be attached to the tray.

BRIEF DESCRIPTION OF THE DRAWING

For a better understanding of these and further objects of the present invention, reference will be had to the following detailed description of the invention which is to be read in association with the accompanying drawings, wherein.

DETAILED DESCRIPTION OF THE INVENTION

Figure 1:
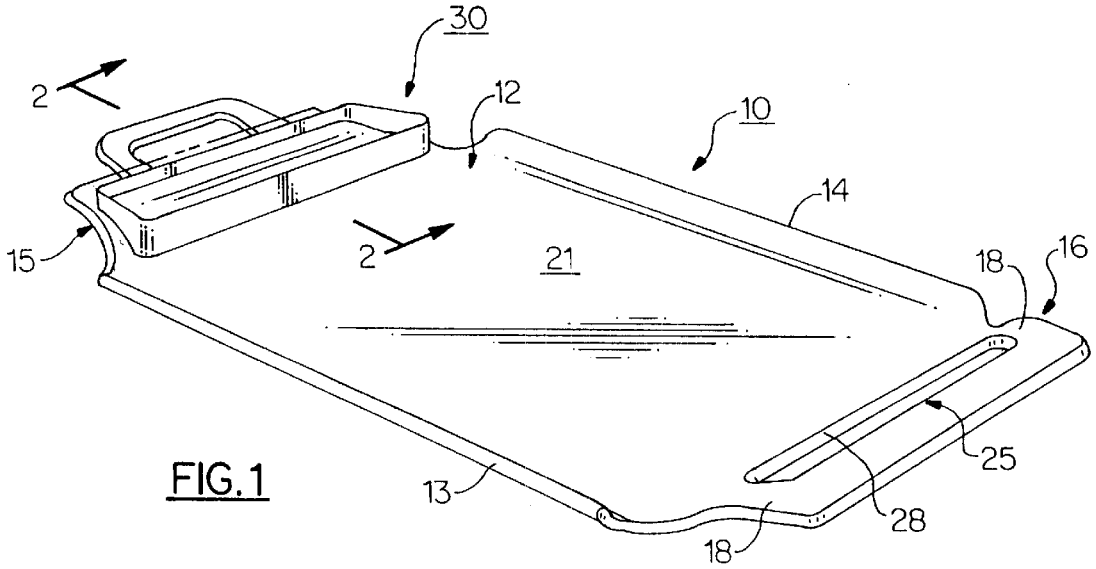
FIG. 1 is a perspective view of a serving tray embodying the teachings of the present invention.
Figure 2:
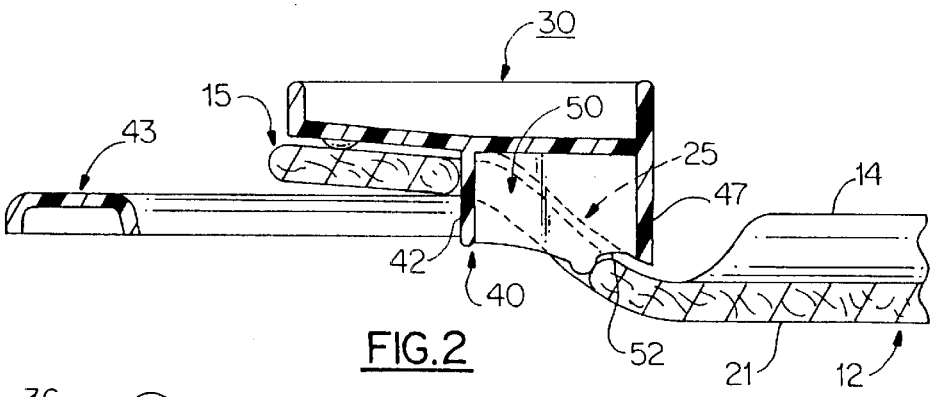
FIG. 2 is a partial sectional view taken along lines 2—2 in FIG. 1.
Figure 3:
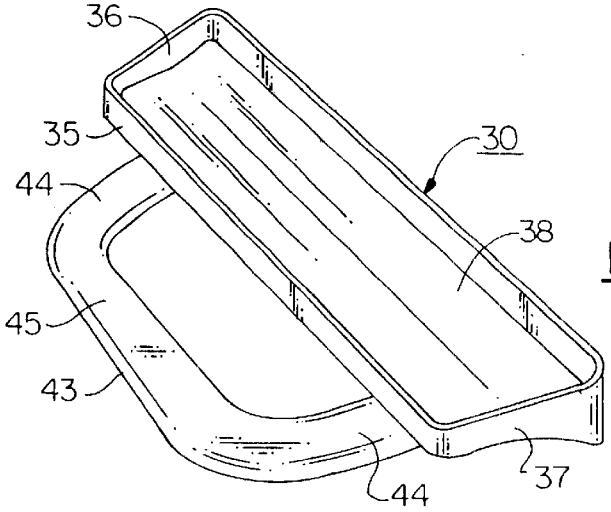
FIG. 3 is an enlarged perspective view showing details of a container that can be releasably secured to one or both ends of the serving tray to increase the carrying capacity of the tray.

Turning now to FIGS. 1–3, there is illustrated a serving tray, generally referenced 10, that embodies the teachings of the present invention. Although the tray can take almost any suitable shape, it contains a generally rectangular-shaped platform 12 having a pair of slightly raised arcuate-shaped side walls 13 and 14 adapted to prevent articles supported upon the platform from sliding off the tray in the event that the tray is tipped slightly to either side. Similar shaped primary handles 15 and 16 are attached to either end of the tray platform by spaced apart arms 18—18. The handles parallel the ends of the tray and are supported by the arms in a raised position such that the bottom surface 20 of each handle is elevated a given distance above the top surface 21 of the tray platform.

As best illustrated in FIGS. 1 and 2, the primary handles extend substantially along the entire width of the tray and are set back by the arms to establish an elongated opening 25—25 between each handle and an adjacent end of the tray platform to allow the handles to be securely grasped by one carrying the tray. The back edge 27 of each handle provides the upper side edge of each elongated opening while the adjacent end of the tray platform 28 provide the lower side edge of each elongated opening. The raised primary handles, like the two side walls 13 and 14 of the tray, prevent articles situated upon the tray from sliding off the tray when the tray in is tilted.

Although the tray is described with specific reference to that illustrated in FIG. 1, it should be clear that any tray of similar design may be used in the practice of the present invention without departing from the claimed invention.

A container, generally referenced 30, is shown in FIG. 1 mounted at one end of the tray. Although only one container is displayed in FIG. 1, it should become evident from the disclosure below that a second container of similar construction may be mounted at the opposite end of the tray without departing from the teachings of the present invention. The container includes a rectangular-shaped open topped compartment having two side walls 34 and 35 and two end walls 36 and 37 that raise up from a flat bottom wall 38. The length of the compartment may be slightly less than the overall width of the tray handles or may extend outwardly beyond the two sides of the tray.

A first front rib 40 depends from the bottom wall of the compartment. The rib is located at about the midsection of the compartment and runs along the length of the compartment between the end walls parallel with the side walls. The rib has a front face 42 to which an auxiliary handle unit, generally referenced 43, is integrally joined. The auxiliary handle is a U-shaped element having a pair of arms 44—44 that are cojoined by the auxiliary 45. A second rear rib 47 is placed in parallel alignment with the rear side wall 34 of the open top compartment so that it also depends downwardly from the bottom wall of the compartment.

The two ribs are cojoined by a series of spaced apart partitions 50 that are perpendicularly aligned with the ribs. The bottom surface 51 of each partition contains a contoured recess 52 that is adapted to snap over the lower edge 28 of either elongated opening 25 when the container is brought to a latched position with the serving tray.

The container is latched to the tray by first inserting the auxiliary handle 43 of a container through one of the elongated openings 25 in the tray. The container is moved toward the primary handle until the front face 42 of rib 40 is registered in abutting contact against the upper edge 28 of the elongated opening. At this time, the contoured recesses 52 contained in the partitions are aligned over the lower edge of the elongated opening using a slight downward pressure on the container to snap the lower edge of the opening thus releasably securing the container to the tray. The container is removed from the tray by simply reversing the above described procedures.

Although only one container is illustrated secured to the tray in FIG. 1, it should be evident to one skilled in the art that a container may be snap fitted to both ends of the tray to further increase the carrying capacity of the tray. The open top compartment of each container has sufficient area to permit a wide variety of articles such as flatware, salt and pepper shakers, napkins, drinking glasses and the like to be safely stored and carried therein thus providing additional space upon the tray platform for additional articles to be carried. As noted above depending upon the size of a given load, one or two containers may be secured to the tray to accommodate the load.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. Apparatus for increasing the carrying capacity of a serving tray that includes:

said serving tray containing a flat platform having opposed ends, a raised primary handle connected to each end of the platform by a pair of spaced apart arms to establish an elongated opening between each primary handle and an adjacent end of said platform so that each elongated opening contains a first upper side edge extending along one side of the primary handle and a second lower side edge extending along one end of said platform;

at least one open top container having a bottom wall and raised side walls, said container further including an auxiliary handle attached to the container that extends outwardly beyond one side wall of the container so that the auxiliary handle can pass through one of said elongated openings beneath the primary handle and position the bottom wall of the container over the primary handle when the container is brought to a latched position; and latching means for releasably securing the container to said serving tray when the container is in said latched position.

2. The apparatus of claim 1 that further includes a container releasably secured to each end of said serving tray.

3. The apparatus of claim 2 wherein each container further includes a first rib depending downwardly from the bottom wall of the container, said rib having a front face that is in contact with the first upper side edge of an elongated opening when the container is placed in the latched position and a rear face from which a series of partitions entend so as to releasably engage the lower side edge of said elongated opening when the container is in a latched position.

4. The apparatus of claim 3 wherein each container further includes a second rib depending downwardly from the bottom wall of the container behind the rear face of the first rib and wherein said partitions are connected to said first and second ribs.

5. The apparatus of claim 3 wherein said auxiliary handle is connected to the front fact of said first rib.

6. The apparatus of claim 4 wherein each partition contains a bottom surface having a contoured recess for releasably engaging the lower edge of one of said elongated openings when the container is placed in the latched position.

7. The apparatus of claim 4 wherein said container, said auxiliary handle, said ribs and said partitions are integrally molded from a plastic material.

* * * * *